US007574808B2

(12) United States Patent
Mah et al.

(10) Patent No.: US 7,574,808 B2
(45) **Date of Patent: *Aug. 18, 2009**

(54) MECHANISM FOR CAN OPENER

(75) Inventors: Pat Y. Mah, Kowloon (HK); Mark Andrew Sanders, Windsor (GB)

(73) Assignee: Daka Research Inc. (Br. Virg. Isl Corp.), Tortolla (VG)

( * ) Notice: Subject to any disclaimer, the term of this patent is extended or adjusted under 35 U.S.C. 154(b) by 0 days.

This patent is subject to a terminal disclaimer.

(21) Appl. No.: 11/728,288

(22) Filed: Mar. 22, 2007

(65) Prior Publication Data

US 2007/0180712 A1 Aug. 9, 2007

Related U.S. Application Data

(63) Continuation-in-part of application No. 11/299,986, filed on Dec. 12, 2005, now Pat. No. 7,437,825.

(51) Int. Cl.
*B67B 7/46* (2006.01)

(52) U.S. Cl. ..... 30/404; 30/401; 30/403; 30/422

(58) Field of Classification Search ..... 30/401, 30/403, 404, 405
See application file for complete search history.

(56) References Cited

U.S. PATENT DOCUMENTS

| | | | | |
|---|---|---|---|---|
| 1,556,385 | A | 10/1925 | Waller | |
| 1,945,137 | A | 1/1934 | Dahl | |
| 2,461,015 | A | 2/1949 | Withrow | |
| 2,522,383 | A | 9/1950 | Lampl | |
| 2,523,382 | A | 9/1950 | Lampl | |
| 2,592,936 | A | 4/1952 | McLean | |
| 2,712,689 | A * | 7/1955 | Chambers | 30/402 |
| 2,718,056 | A | 9/1955 | Burnett | |

(Continued)

FOREIGN PATENT DOCUMENTS

| | | |
|---|---|---|
| CA | 1200086 | 2/1986 |

(Continued)

OTHER PUBLICATIONS

German Patent No. 379929, of Aug. 31, 1923.

(Continued)

*Primary Examiner*—Hwei-Siu C Payer
(74) *Attorney, Agent, or Firm*—Curtis L. Harrington; Kathy E. Harrington; Harrington & Harrington

(57) ABSTRACT

There is provided a mechanism for use in a can opener comprising a body; rotationally mounting to the body about a first axis, a drive wheel for engaging the rim of the can; rotationally mounting to the body about a second axis and drivably rotatable by the drive wheel, a cutter wheel; eccentrically mounting to the cutter wheel, a cutting knife movable on rotation of the cutter wheel to a cutting position in which the cutting knife forms a nip with the drive wheel such that the cutting knife penetrates through the cylindrical wall of the can, and in which an electrical sensor can be used to reverse the position of the cutting wheel back to a start position and in which a mechanical sensor can be used in conjunction with a locking bar to advance the cutting wheel back to a start position.

18 Claims, 16 Drawing Sheets

U.S. PATENT DOCUMENTS

| | | | | | |
|---|---|---|---|---|---|
| 2,779,096 | A | * | 1/1957 | Moore | 30/402 |
| 3,159,912 | A | * | 12/1964 | Posener | 30/403 |
| 3,307,255 | A | * | 3/1967 | Hubrich | 451/461 |
| 3,528,175 | A | * | 9/1970 | Rich | 30/403 |
| 3,689,997 | A | | 9/1972 | McLean | |
| 3,740,840 | A | * | 6/1973 | McLaren et al. | 30/403 |
| 3,815,226 | A | * | 6/1974 | Marrie | 30/421 |
| 4,227,473 | A | * | 10/1980 | Young | 413/78 |
| 4,365,417 | A | | 12/1982 | Rosendahl | |
| 4,563,818 | A | | 1/1986 | Kreth et al. | |
| 4,825,554 | A | | 5/1989 | Koo | |
| 4,860,455 | A | * | 8/1989 | Conneally | 30/404 |
| 5,022,159 | A | | 6/1991 | Cressman et al. | |
| 5,170,565 | A | * | 12/1992 | Brisard | 30/401 |
| 5,313,708 | A | | 5/1994 | Edwards et al. | |
| 5,664,333 | A | | 9/1997 | Hardman | |
| 6,058,613 | A | | 5/2000 | So | |
| 6,182,368 | B1 | | 2/2001 | So | |
| 6,298,563 | B1 | | 10/2001 | Yeadon | |
| 6,351,889 | B1 | | 3/2002 | Wall et al. | |
| 6,505,405 | B2 | | 1/2003 | Hui | |
| 6,516,524 | B1 | | 2/2003 | Brady | |
| 6,739,061 | B1 | | 5/2004 | Montel | |
| 6,886,260 | B1 | | 5/2005 | Lee | |
| 7,213,340 | B1 | | 5/2007 | Lee | |
| 7,437,825 | B2 | * | 10/2008 | Sanders et al. | 30/422 |
| 2002/0144412 | A1 | | 10/2002 | Hui | |
| 2005/0235501 | A1 | | 10/2005 | So | |
| 2007/0033814 | A1 | | 2/2007 | So et al. | |

FOREIGN PATENT DOCUMENTS

| | | |
|---|---|---|
| EP | 0193278 | 9/1986 |
| EP | 0574214 | 12/1993 |
| GB | 2118134 | 10/1983 |

OTHER PUBLICATIONS

Great Britain Patent No. 820,996 to Henning Waldemar Lindahl entitled Improvements in and Relating to Can Openers; Published Sep. 30, 1959.

Swiss Patent No. 471,034 "Buchsenoffner" by Walter Steiner Winterhur, Published Apr.15, 1969.

EPO Patent No. 0137592 Al, to Mike & Kremmel Ltd & Raffo entitled "Improvements Relating to Can Openers" & Published Apr. 17, 1985.

EPO Patent No. 0202790 Al, to Mike & Kremmel & entitled "Improvements Relating to Can Openers" & Published Nov. 26, 1986.

Great Britain Patent No. 1,215,196 to Donald Aston entitled Can Opener; Published Dec. 9, 1970.

French Patent registration 72.20542 published as 2.187.674 by Olof Thoren published Jan. 18, 1974 titled "Presse-Tube".

EPO Patent No. 0503931A1, to Wilson & Raffo entitled "Can Opener" & Published Sep. 16, 1992.

Japan Patent No. JP8113294 entitled "Electric Can Opener" issued May 7, 1996.

* cited by examiner

MECHANISM FOR CAN OPENER

CROSS-REFERENCE TO RELATED APPLICATION

This application is a continuation-in-part of U.S. patent application Ser. No. 11/299,986 filed Dec. 12, 2005, now U.S. Pat. No. 7,437,825.

BACKGROUND OF THE INVENTION

1. Field of the Invention

The present invention relates to a mechanism for use in a can opener that may be provided with a manual or automated drive means.

Metal cans are a well-known form of packaging for preserved goods and generally comprise a cylindrical wall portion closed at both ends with a circular lid. The lid is usually fixed in place by providing an upstanding rim around the edge of the lid which is bent down in an inverted U-shape for clamping onto the end of the cylinder.

2. Related Background Art

Two basic types of can opener are commonplace. The first type relies on making a circular cut around the lid near its edge typically within the upstanding rim. The second type relies on using a circular cutter knife to make a cut around the cylindrical wall portion of the can. Typically, the cut is made near the edge of the cylindrical part of the can but just below the lid so that when a complete circular cut is made, the lid and a small portion at the end of the cylindrical part of the can and rim is removed. One advantage of this second type of can opener is that its cutter knife is designed to give a clean cutting action as opposed to a tearing action which typically is found with can openers of the first type.

United Kingdom Patent application No. GB 2 118 134 A1 describes a can opener of the second type comprising a pair of handles which are hinged to one another to be movable between an open position for fitting onto a can and a closed cutting position; a manually rotatable drive wheel which engages the rim of a can and upon rotation advances the opener around a can; and a circular cutting wheel brought to a cutting position relative to the drive wheel as the handles are brought to the closed position. The circular cutting wheel is rotatably mounted on one handle with its axis displaced from the axis of hinging. The other handle has an upstanding cylindrical spigot extending through a corresponding hole in the one handle and about which the one handle is hinged relative the other handle. A support for the drive wheel passes through and is rotatably born in the spigot with the axis of rotation of the drive wheel displaced from the axis of the spigot.

Can openers of the general type described in the GB 2 118 134 A1 document have been widely marketed for a number of years under the trade mark Lift Off. Various improvements to such can openers have been described in later patent applications including Canadian patent application No. CA 1 200 086 A1; and European patent applications Nos. EP 0 193 278 A1, EP 0 202 790 A1 and EP 0 574 214 A1.

One problem with the can opener of GB 2 118 134 A1 and of its later variations is that two separate kinds of actions are required to achieve the cutting function. Firstly, the two handles must be brought together, typically by a manual squeezing action. Subsequently, rotary drive must be provided to the drive wheel. The Applicant has appreciated that such requirement for these two separate kinds of actions makes it difficult to fully automate a can opener of this type. Indeed, the GB 2 118 134 A1 document only envisages manual operability.

In solution to this problem, Applicant has now devised a can opener mechanism, which relies only on the provision of rotary drive, preferably to a single drive wheel. Such rotary drive may be provided by manual or automatic (i.e. powered) drive means.

SUMMARY OF THE INVENTION

According to one aspect of the present invention there is provided a mechanism for use in an opener for a can, said can comprising a cylindrical wall closed at each end with a circular lid fixed thereto by means of an upstanding rim around the edge of said lid that clamps onto said each end of said cylindrical wall, said mechanism comprising a body;

rotationally mounting to said body about a first axis, a drive wheel for engaging the rim of the can;

rotationally mounting to said body about a second axis and drivably rotatable by said drive wheel, a cutter wheel;

eccentrically mounting to said cutter wheel, a cutting knife movable on rotation of the cutter wheel to a cutting position in which the cutter knife forms a nip, along with a cylindrical part under the cutter knife, such as a spacer washer, on the same axis and mounting that grips the rim. This arrangement with the drive wheel is such that the cutting knife penetrates through the cylindrical wall of the can to provide a cut therein as the opener orbits relatively therearound, wherein said cutting position is defined by a cutting interval corresponding to a segment of rotation of the cutter wheel in which the cutting knife is sufficiently proximal to the drive wheel to form said nip; and provided to the cutter wheel, intermittent drive means for providing intermittent drive between the drive wheel and the cutter wheel when the cutting knife is in the cutting position such as to maintain the nip in place for a sufficient cutting interval to provide a full orbital cut around the cylindrical wall of the can.

There is provided a mechanism for use in a can opener. The can is of the standard type and typically comprises a cylindrical wall closed at both ends with a circular lid fixed to each end by means of an upstanding rim around the edge of said lid clamping onto said each end of said cylindrical wall.

The mechanism comprises a body, the primary function of which is to provide a base or surface for mounting of the drive wheel and cutter wheel. Thus, the body typically defines a relatively simply planar form, which in aspects, may be supplemented by features to accommodate receipt of the can and/or to facilitate ease of use by the user.

Rotationally mounting to said body about a first rotational axis there is provided, a drive wheel for engaging the rim of the can.

Rotationally mounting to said body about a second rotational axis, which is necessarily distinct from the first rotational axis, there is provided a cutter wheel. The cutter wheel is arranged to be drivably rotatable by the drive wheel. Typically, gear teeth of the drive wheel and cutter wheel mesh together directly, although variations are envisaged in which an indirect drive relationship exists.

Eccentrically mounting to the cutter wheel, there is provided a cutting knife. By 'eccentrically mounting' it is meant that the cutting knife mounts to the cutter wheel in eccentric (or 'displaced') fashion relative to the second rotational axis. Typically, the cutting knife is circular in profile, and the eccentric mounting therefore means that as the cutter wheel is rotated, the central point of the circular cutting knife is also rotated about that axis such that the edge of the circular cutting knife is displaced.

In particular, the cutter wheel is rotatable to a cutting position in which the cutter knife is displaced to a position in which it forms a nip, with its associated structures, with the drive wheel such that in use, the cutting knife penetrates through the cylindrical wall of the can to provide a cut therein as the opener orbits relatively therearound.

The cutting position is defined by a cutting interval corresponding to a segment of rotation of the cutter wheel in which the cutting knife is sufficiently proximal to the drive wheel to form the nip. That is to say, the cutting nip is in place during a segment of rotation of the cutter wheel defined between the point of rotation of the cutting wheel at which the cutting knife is brought close enough to the drive wheel to just form the cutting nip, with its associated structures, to the point of rotation of the cutting wheel at which the cutting knife moves far enough from the drive wheel for the cutting nip, with its associated structures, to be broken.

It will be appreciated that in order to fully open the can the cutting action of the cutting knife on the cylindrical wall of the can must remain in place for a cutting interval corresponding to more than just a segment of rotation of the can. Indeed, a cutting interval corresponding to at least a full orbit (i.e. 360 degrees rotation) of the can is required for full opening.

Accordingly there is provided to the cutter wheel, an intermittent drive means for providing intermittent drive between the drive wheel and the cutter wheel when the cutting knife is in the cutting position such as to maintain the nip, with its associated structures, in place for a sufficient cutting interval to provide the necessary full orbital cut around the cylindrical wall of the can.

In essence, it will be appreciated that the function of the intermittent drive means is to extend the cutting interval to be sufficient to provide the required full orbital cut. The intermittent drive means provides such function by providing only intermittent (e.g. stepped) drive between the drive wheel and the cutter wheel when the cutting knife is in the cutting position. Once the full orbital cut has been provided to the can wall, the cutter wheel rotates on further and beyond the cutting position and the normal (i.e. non-intermittent) drive relationship is restored between the cutter and drive wheels. Suitably, the intermittent drive means comprises a Geneva mechanism or equivalent thereto.

Suitably, the cutter wheel is arranged such that at the cutting position the usual drive relationship between the drive wheel and cutter wheel is disengaged. This is for example, achieved by removing teeth from the segment of the cutter wheel corresponding to the cutting interval (i.e. corresponding to the segment of rotation of the cutter wheel in which the cutting knife is sufficiently proximal to the drive wheel to form the cutting nip, with its associated structures).

The required intermittent drive means (that provides the intermittent drive relationship between the drive wheel and the primary drive teeth of the cutter wheel) is suitably achieved by providing the drive wheel with a drive peg (or tooth or equivalent feature) arranged for intermittent drive action with an intermittently drivable element provided to the cutter wheel. Suitably, the intermittently drivable element comprises a curved rack of drive teeth (e.g. a segment of a full circle of intermittent drive teeth) that is suitably positioned on the cutter wheel. Clearly, the drive peg must not interact with the primary drive teeth of the cutter wheel and hence, the drive peg and intermittent drive teeth are suitably arranged for drivable rotation about a rotational plane spaced from the rotational plane of the drive wheel and the cutter wheel. Preferably, however the drive peg and the intermittent drive teeth share the same rotational axis as the drive wheel and cutter wheel respectively.

Preferably, the intermittent drive means is additionally provided with control means to prevent intermittent rotation of the cutter wheel (either backwards or forwards, or preferably both) other than in response to the driving engagement of the drive peg with the intermittent drive teeth. The control means may additionally function to align the drive peg with the intermittent drive teeth to ensure smooth intermittent drive interaction.

Suitably, the control means comprises a control peg (or tooth or equivalent feature) provided to the drive wheel and arranged to be movable to engage/disengage a curved rack of control teeth (e.g. a segment of a full circle of control teeth) provided to the cutter wheel. The engage/disengage movement of the control peg with the curved rack may for example, be achieved by a suitable engage/disengage feature (e.g. one or more cams or other control surface(s)) arranged such that the control peg disengages the curved rack just prior to engagement of the drive peg with the intermittently drivable element and engages the curved rack subsequent thereto.

Where one or more cams are employed to provide the engage/disengage feature these may either be on the same or on a separate rotational axis to the drive wheel. Thus, the cutter wheel never has any free movement, which could for example, otherwise lead to it either not cutting the can or to it becoming un-synchronised with the drive wheel.

Alternatively, the control means comprises a control surface (e.g. an upstanding broken circular wall) provided to the drive wheel and arranged to engage/disengage one or more (e.g. a pair of spaced) control pegs provided to the cutter wheel. The engage/disengage movement of the control surface with the one or more control pegs may for example, be arranged such that the control surface disengages the one or more control pegs just prior to engagement of the drive peg with the intermittently drivable element and engages the one or more control pegs subsequent thereto. Thus, again the cutter wheel never has any free movement, which could for example, otherwise lead to it either not cutting the can or to it becoming unsynchronized with the drive wheel. This type of control mechanism may be regarded as a 'rotating wall Geneva'. An advantage of this approach is its simplicity.

In another aspect, the control means comprises a spacing element provided to the drive wheel and arranged for intermittent spacing interaction with the cutter wheel such as to space the drive peg from the intermittent drive teeth (and hence, prevent any driving action other than at the desired intermittent drive position). Thus, suitably the spacing interaction between the drive peg and intermittent drive teeth is in place until just prior the point of engagement of the drive peg with the intermittently drivable element and the spacing again provided subsequent thereto. Generally, the spacing is provided along the axes of rotation of the drive and cutter wheel.

In one aspect, the spacing element comprises an upstanding curved wall (e.g. a broken circular wall) provided to the drive wheel that is arranged for interaction with the base of the cutter wheel such as to push (i.e. space) the cutter wheel away from (e.g. upwards from) the drive wheel other than at the desired intermittent drive position (e.g. corresponding to the break in the circular wall).

The mechanism herein requires movement of the cutter wheel to a cutting position in which the cutter knife forms a nip, with its associated structures, with the drive wheel. It is desirable that the nip, with its associated structures, is as effective as possible.

Suitably, a spacer washer is therefore provided to the cutter wheel, which spacer washer shares the same second axis of rotation. The spacer washer is provided with a connector for connecting to the cutter wheel such that both may rotate together during the cutting action. The spacer washer is typically fashioned of resilient material e.g. rubber or a suitable synthetic polymer. Use of such a resilient material provides for a wider tolerance of grip. This in turn, enables the cutting segment angle to be maximized. It is this washer that, along with the drive, grips the rim of the can.

Suitably, the connector of the spacer washer comprises an upstanding non-circular (e.g. square-shaped) spigot arranged to project into a corresponding non-circular (e.g. square-shaped) hole provided to the cutter wheel.

According to a further aspect of the present invention there is provided a can opener comprising the mechanism described above and drive means for driving the drive wheel thereof. The can opener typically comprises a housing shaped for receipt of the can and/or providing features facilitating user operability. Thus, for example, grip features may be provided to facilitate manual handling.

In one aspect, the drive means is adapted for manual drive and may include any suitable means of manually providing rotary drive to the drive wheel. In another aspect, the drive means is adapted for automated (i.e. powered drive) and may include any suitable means of automatically providing rotary drive to the drive wheel.

Suitable manual or automatic drive means may provide drive directly or may transfer drive through any suitable gearing (e.g. through a gear box) or any component/apparatus arranged to provide mechanical advantage (e.g. lever, cam or pulley).

Suitable automated drive means may be powered by any suitable motor or engine, but typically are powered by an electric motor, which may be mains or battery powered.

Initial actuation of the drive means is preferably arranged to rotate the cutter wheel to the cutting position in which the cutting knife penetrates through the cylindrical wall of the can, further actuation of the drive means being arranged to rotate the drive wheel to cause the opener to orbit around the can to form the cut therein.

Yet further actuation of the drive means is preferably arranged to rotate the cutter wheel away said cutting position following completion of the cut.

According to a further aspect of the present invention there is provided the use of the can opener described herein for removing the lid of a can.

In a further aspect of the present invention, a reversing eccentric mechanism may be employed in which the can opener can be reversed slightly to cause disengagement of the can opener with respect to the can. Reversal can occur manually or by a number of sensor inputs. Sensor inputs can include can position, cutter resistance or drive current reduction and more. This mechanism can be introduced where it is desired to replace a feed-forward mechanism which is programmed to provide cutting for a given length of can perimeter.

In a further aspect of the present invention, a locking eccentric mechanism provides a mechanical set and re-set based upon the use of a physical sensor which detects the presence of the not completely cut can. The locking bar is moved into a fixed socket which locks the cutter wheel to keep the blade in place during cutting. When the can lid is completely cut, the sensor is able to pushably displace the can with respect to the other mechanical components by a pushing action. This pushing action causes the locking bar to change to an unlocked position in which it not only frees itself from the fixed socket to free the cutter wheel, but also places the other end of the locking bar in a position to be pushed to re-start a toothed engagement with the cutter wheel by moving the teeth of the cutter wheel to a position in which the opposing teeth of the drive wheel can re-engage it and move it another half turn to cause the cutter wheel to disengage the now cut can lid.

At the point where a half turn has caused the cutter wheel to disengage the now cut can lid, the cutter wheel is in a start position. The start position may be maintained by having the operator simply stop the rotation of the drive gear, or by an electronic sensing of the advance of the drive gear, where the motor is stopped pending re-activation. Where it is desired to reverse back to the star, an upstand may be used to define the start.

BRIEF DESCRIPTION OF THE DRAWINGS

Embodiments of the present invention will now be described with reference to the accompanying drawings in which.

DETAILED DESCRIPTION OF THE PREFERRED EMBODIMENTS

Figure 1:
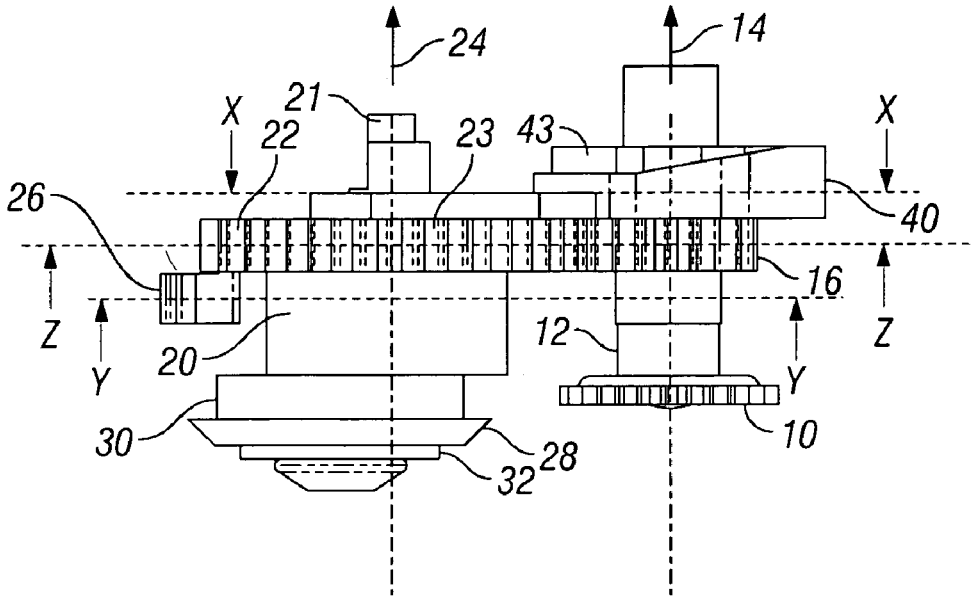
FIG. 1 shows a side view of a first can opener mechanism herein in the start (i.e. can disengaged) position.

Referring now to the drawings, at FIGS. 1 to 4 there is shown a first can opener mechanism herein in the start (i.e. can disengaged) position. The mechanism comprises toothed drive wheel 10 mounted on drive spindle 12 arranged for rotation about drive axis 14. Also mounted on drive spindle 12 is drive gear 16, which is arranged to mesh with outer gear teeth 23 of the cutter drive gear 22 provided to cutter wheel 20 for drivable rotation thereof on cutter spindle 21 about cutter wheel axis 24. It may be seen at FIG. 2. that on the left hand side of the cutter drive gear 22 several outer gear teeth 23 are missing and replaced by inner gear teeth 25 and upstanding curved rack of teeth 26, the function of both of which will become clearer from the later description.

The cutter wheel 20 is further provided with a circular cutting knife 28, which eccentrically mounts thereto such that as the cutter wheel rotates about its axis 24 the cutting knife 28 is brought into close proximity with drive wheel 10 to form a nip, with its associated structures, therebetween. The formation of this nip, with its associated structures, in use corresponds to a cutting position in which the cutting knife 28 penetrates through the cylindrical wall 2 of a can 1 (see FIG. 4) to provide a cut therein as the opener orbits relatively therearound. As will again be appreciated from the later description, the cutting position is defined by a cutting interval corresponding to a segment of rotation of the cutter wheel 20 in which the cutting knife 28 is sufficiently proximal to the drive wheel 10 to form the nip, with its associated structures.

Figure 4:
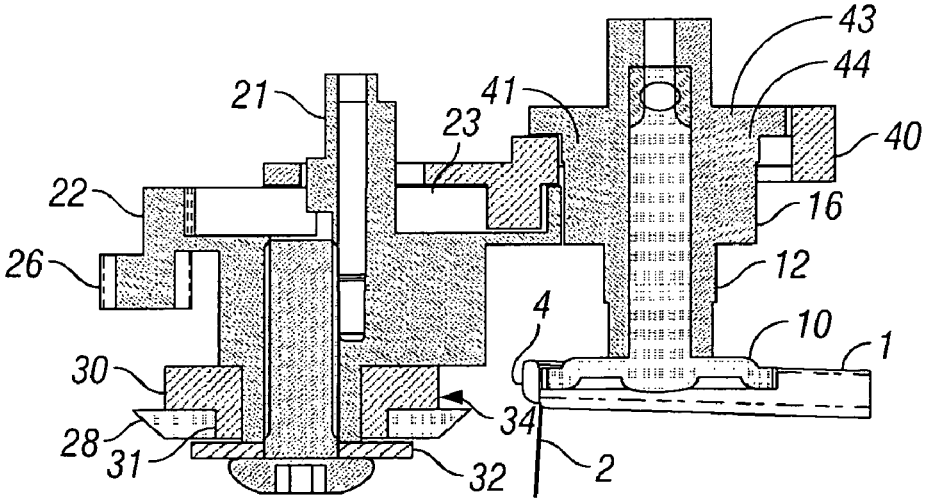
FIG. 4 shows a sectional view along Section A-A of FIG. 3.
Figure 5A:
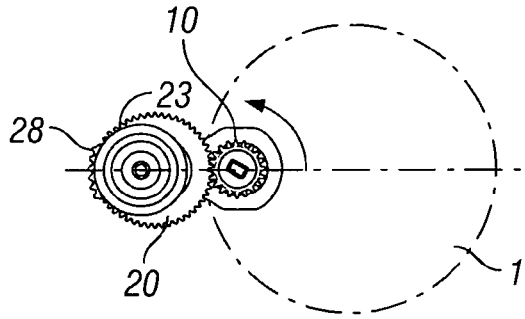
FIGS. 5*a* to 5*g* show views from underneath of the first can opener mechanism of FIG. 1 and its interaction with a can during sequential parts of a can opening operation.
Figure 6A:
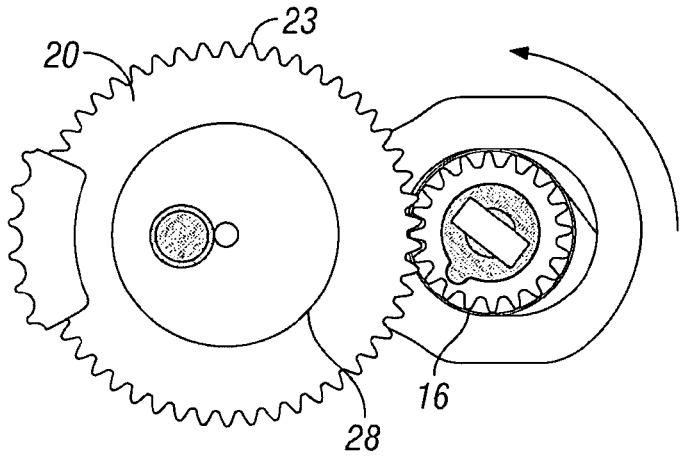
FIGS. 6*a* to 6*g* show sectional views from underneath taken along Section Y-Y of the first can opener mechanism of FIG. 1 and its interaction with a can during sequential parts of a can opening operation.
Figure 7A:
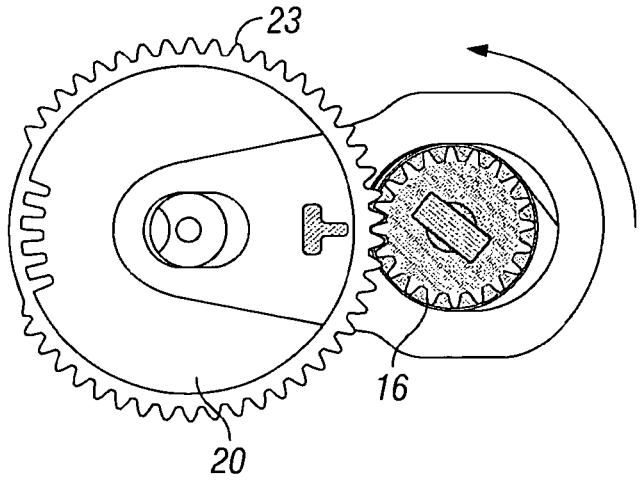
FIGS. 7*a* to 7*g* show sectional views from underneath taken along Section Z-Z of the first can opener mechanism of FIG. 1 and its interaction with a can during sequential parts of a can opening operation.
Figure 5B:
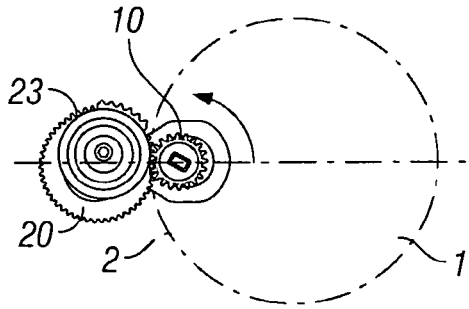
Figure 6B:
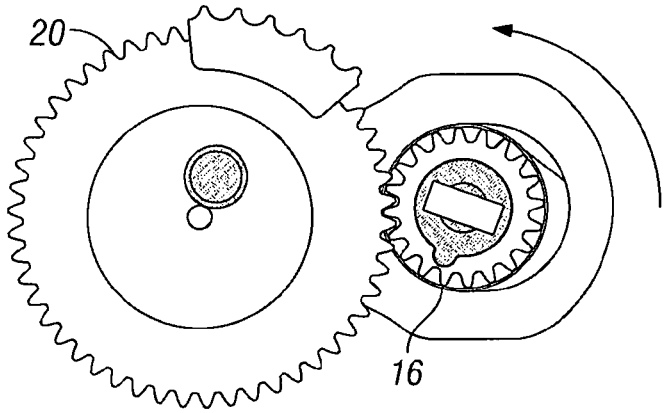
Figure 7B:
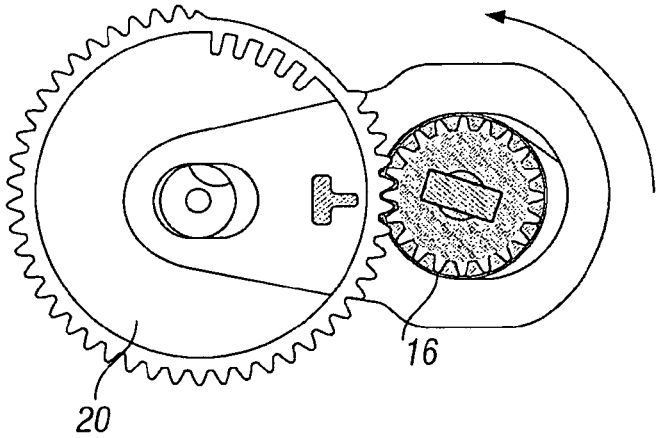
Figure 5C:
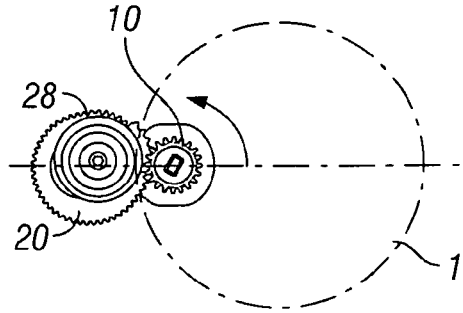
Figure 6C:
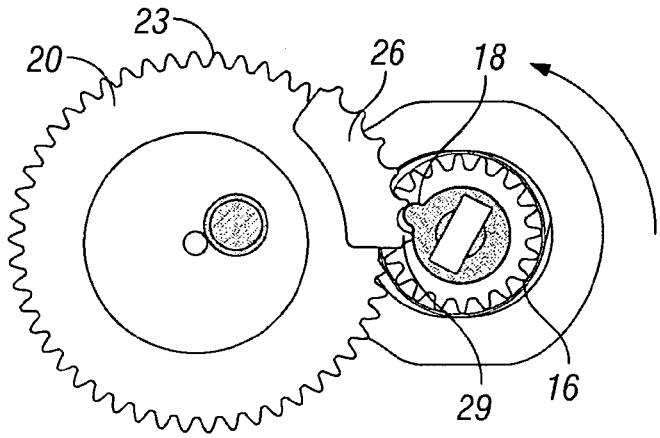
Figure 7C:
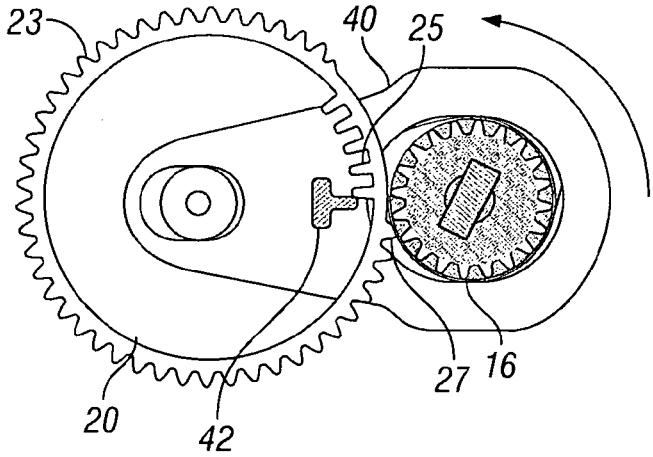
Figure 5D:
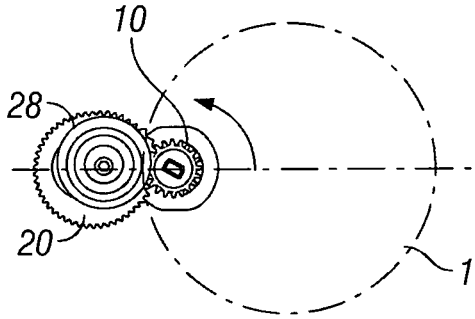
Figure 6D:
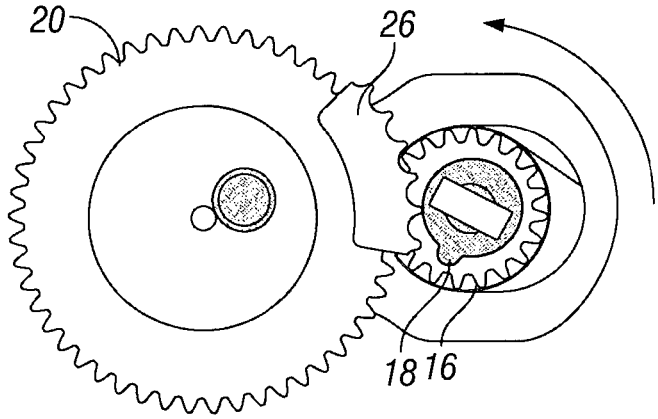
Figure 7D:
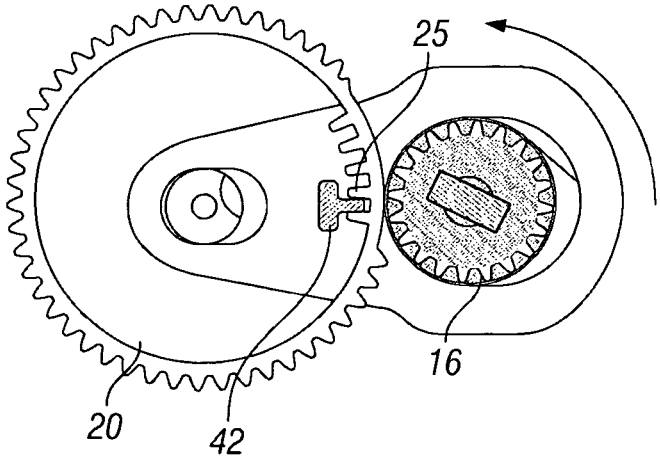
Figure 5E:
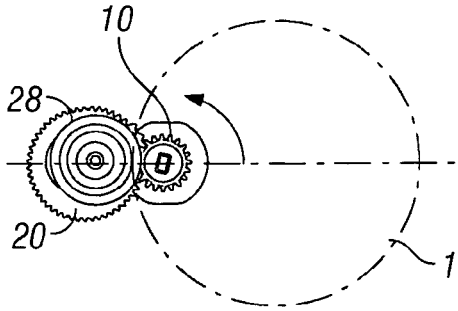
Figure 6E:
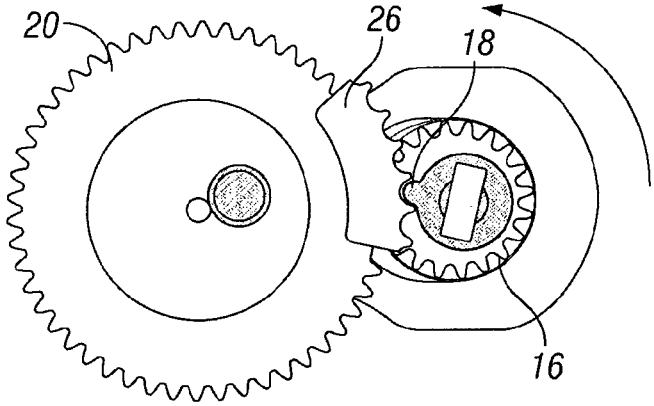
Figure 7E:
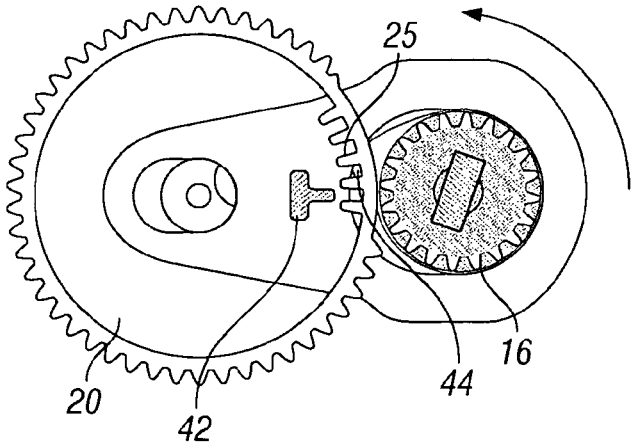
Figure 5F:
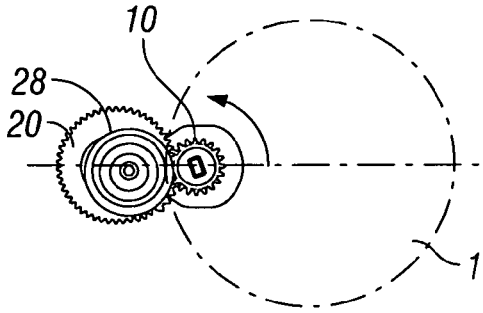
Figure 6F:
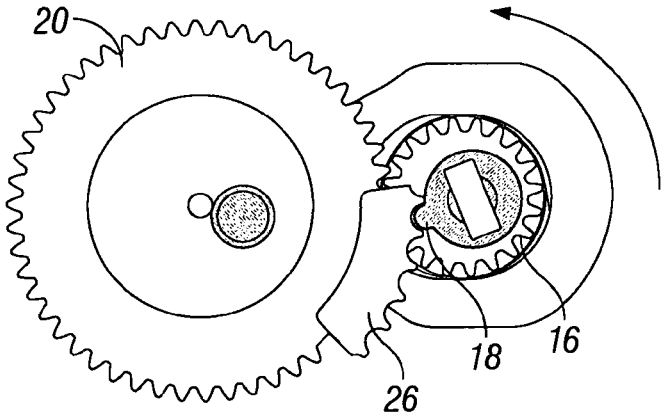
Figure 7F:
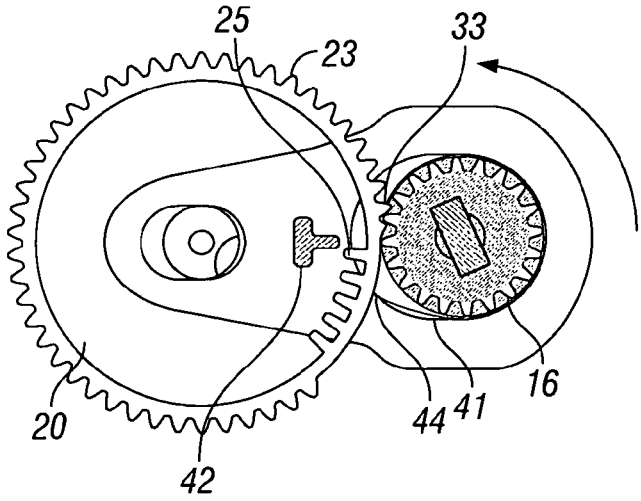
Figure 5G:
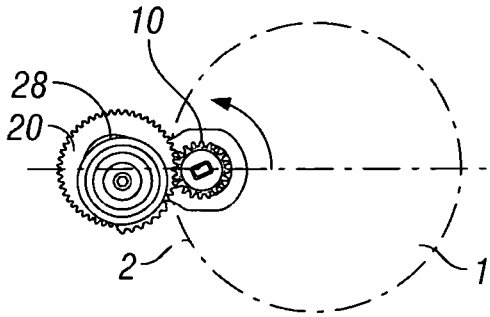
Figure 6G:
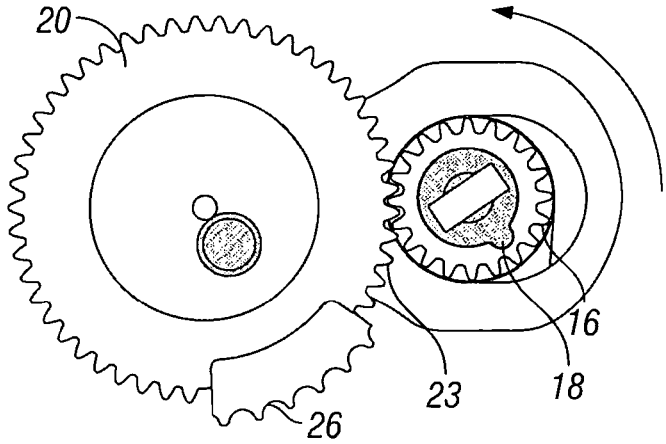
Figure 7G:
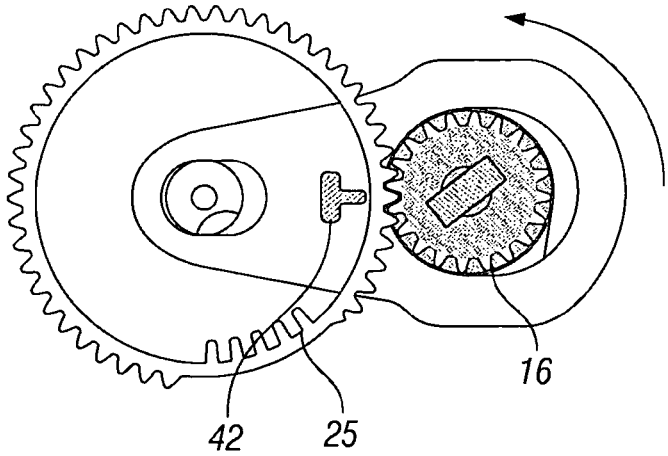

As best seen at FIGS. 1 and 4, spacer washer 30 and connector 31 therefor are provided to the cutter wheel 20 wherein both share axis of rotation 24 with the cutter wheel 20. The connector 31 comprises an upstanding non-circular spigot, which projects into a corresponding non-circular hole provided to the cutting knife 28 and is topped by end washer 32. The function of the spacer washer 30 is primarily to provide a cavity 34 for receipt of the protruding lid 4 of the can. Applicant has found that gripping of the can is improved wherein the spacer washer 30 comprises a resilient material (e.g. rubber or a synthetic polymer).

The cutter wheel 20 is further provided with intermittent drive means for providing intermittent drive between the drive wheel 10 and the cutter wheel 20 when the cutting knife 28 is in the cutting position such as to maintain the nip, with its associated structures, in place for a sufficient cutting interval to provide a full orbital cut around the cylindrical wall 2 of the can 1.

The intermittency of drive is essentially provided by the gap ('missing teeth') in the outer gear teeth 23 of the cutter drive gear 22, which causes a break in the meshed interaction with the drive gear 16 of the drive wheel 10. At that point, drive peg 18 is brought into interaction with the upstanding curved rack of teeth 26 such that for each rotation of the drive wheel 10 the cutter wheel 20 is 'kicked on' on by one tooth of the curved rack 26. Ultimately, the cutter wheel 20 gets 'kicked on' sufficiently that the drive gear 16 again meshes with the outer gear teeth 23 of the cutter drive gear 22 thereby resuming the normal drive relationship between drive wheel 10 and cutter wheel 20. The intermittent drive may thus, be appreciated to be a kind of Geneva mechanism. For effective working of the opener it will be appreciated that the period of intermittent drive must correspond essentially to the cutting interval required to provide a full orbital cut around the cylindrical wall 2 of the can 1.

Figure 2:
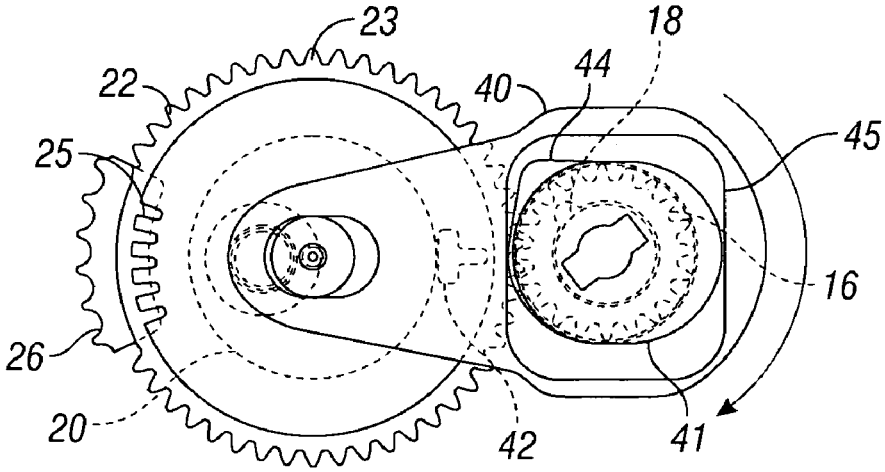
FIG. 2 shows a sectional view along Section X-X of FIG. 1.
Figure 3:
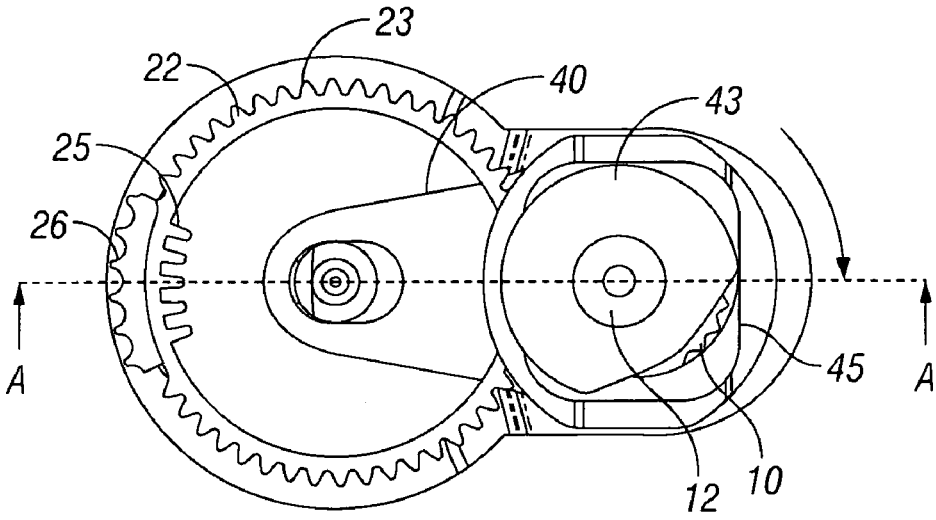
FIG. 3 shows a top view of the first can opener mechanism of FIG. 1 in the start (i.e. can disengaged) position and its interaction with a can.

In an improvement to the basic intermittent drive means, there is further provided a control function to control (i.e. hold still) the cutter wheel 20 during the cutting interval. Thus, as shown at FIG. 2, control bar 40, which mounts to both the drive spindle 12 and cutter spindle 21 (and is laterally movable with respect thereto) is provided with a control peg 42 that meshes intermittently during the cutting interval with the inner gear teeth 25 of the cutter wheel 20. In more detail, control peg 42 is arranged to engage/disengage the inner gear teeth 25 on the cutter wheel 20. The engage/disengage movement of the control peg 42 with the inner gear teeth 25 is achieved by interaction of two cams 43, 44. These are cam 44, which disengages control peg 42 with an inner face 41 of the control bar 40 and cam 43, which engages control peg 42, by interaction with wall 45. The cam 43 may, in embodiments, be replaced by a spring. The set up is arranged such that the control peg 42 disengages the inner gear teeth 25 just prior to engagement of the drive peg 18 with the upstanding curved rack of teeth 26 of the intermittent drive means. Thus, the cutter wheel 20 never has any free movement, which could for example, otherwise lead to it either not cutting the can 1 or to it becoming un-synchronised with the drive wheel 10.

The function of the intermittent drive means and its associated control means may be better understood by reference to FIGS. 5*a* to 5*g*; 6*a* to 6*g*; and 7*a* to 7*g*, which show sequential steps in a can opening action. For simplicity, only the relevant 'active' features of each drawing are labelled.

FIGS. 5*a*-7*a* show the can 1 opening mechanism of FIGS. 1 to 4 in the start position, in which the circular cutting knife 28 of the cutter wheel 20 is fully separated from the drive wheel 10 such that no nip is formed therebetween. The outer gear teeth 23 of the cutter wheel 20 mesh with the drive wheel 10 to allow for normal drivable rotation of the cutter 20 by the drive wheel.

At FIGS. 5*b*-7*b*, the drive wheel 10 has been rotated to drivably rotate the cutter wheel 20 to bring the cutting knife 28 into proximity with the drive wheel 10 and thereby form a nip, therebetween for gripped receipt of the wall 2 of the can 1. This position thus, corresponds to just prior to the start of the cutting interval.

At FIGS. 5*c*-7*c*, the drive wheel 10 has rotated further and beyond the last tooth 27 of the outer gear teeth 23 such that the normal drive interaction between the drive wheel 10 and those outer gear teeth 23 of the cutter wheel 20 is broken. This corresponds to the start of the cutting interval and the intermittent drive mechanism now comes into play. As shown at FIG. 6*c*, drive peg 18 is brought into meshed relationship with the first tooth 29 of the upstanding curved rack of teeth 26. Additionally, control peg 42 on the control bar 40 interacts with the inner gear teeth 25 of the cutter wheel 20 to control (e.g. lock) any undesirable motion thereof.

At FIGS. 5*d*-7*d*, the drive wheel 10 has rotated still further but this rotation results in no rotational drive of the cutter wheel 20 because the drive peg 18 is no longer in meshed relationship with the upstanding curved rack of teeth 26.

Additionally, the locked interaction between control peg 42 and the inner gear teeth 25 of the cutter wheel 20 locks any undesirable motion thereof.

At FIGS. 5*e*-7*e*, the drive wheel 10 has rotated to again bring the drive peg 18 into drivable meshed relationship with the upstanding curved rack of teeth 26 such that further rotation of the drive wheel 10 results in 'kick on' rotation of the cutter wheel 20. Just before this 'kick on' action occurs the engagement between control peg 42 and the inner gear teeth 25 of the cutter wheel 20 is broken in response to the action of cam 44 acting on the inner face 41 of the control bar 40, which pushes the control bar 40 away from the drive wheel 10 to disengage the control peg from the inner gear teeth 25, thereby allowing for the desired 'kick on' movement of the cutter wheel 20.

FIGS. 5*f*-7*f* show the position of the mechanism at the end of the cutting interval (i.e. right at the end of the intermittent drive period and just before disengagement of the cutting knife 28 from its cutting interaction with the can 1). The drive wheel 10 has rotated still further to bring the drive peg 18 into drivable meshed relationship with the final tooth of upstanding curved rack of teeth 26 such that further rotation of the drive wheel 10 results in one last 'kick on' rotation of the cutter wheel 20. As before, to enable this 'kick on' action to occur the control peg 42 and the inner gear teeth 25 of the cutter wheel 20 is disengaged (again in response to the action of cam 44 acting on the inner rim 41 of the control bar 40). Now however, the drive gear 16 is again brought into meshed relationship with the first tooth 33 of the outer gear teeth 23 such that the normal drive relationship between the drive wheel 10 and cutter wheel 20 may be resumed as is shown in FIGS. 5*g*-7*g*.

FIGS. 5*g*-7*g* thus, correspond to the position after the end of the cutting interval. The cutting knife 28 is moved away from the wall 2 of the can 1 and the nip, with the drive wheel 10 is about to be broken such that the can 1 (with lid cut away therefrom) may be removed from the cutter mechanism.

Figure 8:
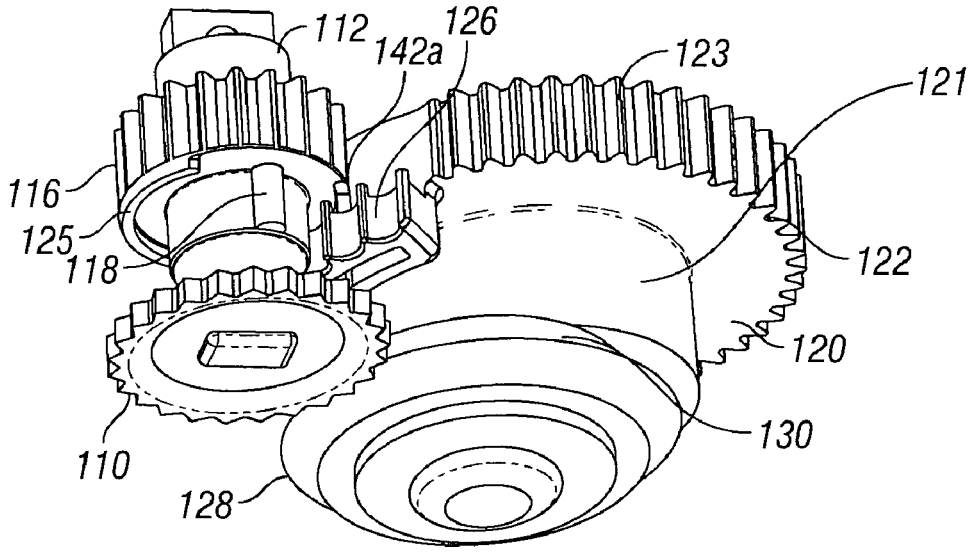
FIG. 8 shows a perspective view from below of a second can opener mechanism herein in the cutting (i.e. can engaged) position.
Figure 9:
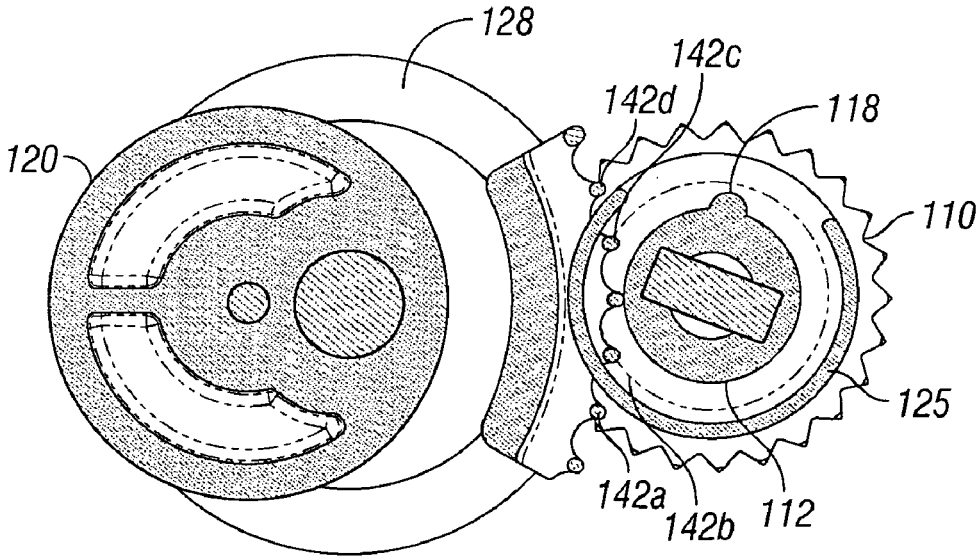
FIG. 9 shows a sectional view looking downwards towards the drive wheel of the second can opener mechanism herein in the cutting (i.e. can engaged) position.

FIGS. 8 and 9 show a second can opener mechanism herein, in which the basic intermittent drive mechanism corresponds to that of the first can opener mechanism of FIGS. 1 to 7*g* but where an alternative control mechanism is employed.

Thus, at FIGS. 8 to 9 there is shown the second can opener mechanism herein in the cutting position. The mechanism comprises toothed drive wheel 110 mounted on drive spindle 112 arranged for rotation about a drive axis. Also mounted on drive spindle 112 is drive gear 116, which is arranged to mesh with outer gear teeth 123 of the cutter drive gear 122 provided to cutter wheel 120 for drivable rotation thereof on cutter spindle 121 about a cutter wheel axis. It may be seen at FIG. 8 that on the left hand side of the cutter drive gear 122 several outer gear teeth 123 are missing and replaced by upstanding curved rack of teeth 126 corresponding to this same feature of the first can opener mechanism.

Again, the cutter wheel 120 is provided with a circular cutting knife 128, which eccentrically mounts thereto such that as the cutter wheel rotates about its axis the cutting knife 128 is brought into close proximity with drive wheel 110 to form a nip, with its associated structures, therebetween. The formation of this nip, with its associated structures, in use corresponds to a cutting position in which the cutting knife 128 penetrates through the cylindrical wall of a can to provide a cut therein as the opener orbits relatively therearound. Again, the cutting position is defined by a cutting interval corresponding to a segment of rotation of the cutter wheel 120 in which the cutting knife 128 is sufficiently proximal to the drive wheel 110 to form the nip, with its associated structures. Spacer washer 130 is also provided to the cutter wheel and has the identical function to that of the first can opener mechanism.

The cutter wheel 120 is again also provided with intermittent drive means for providing intermittent drive between the drive wheel 110 and the cutter wheel 120 when the cutting knife 128 is in the cutting position such as to maintain the nip, with its associated structures, in place for a sufficient cutting interval to provide a full orbital cut around the cylindrical wall of the can.

The intermittency of drive is essentially provided by the gap ('missing teeth') in the outer gear teeth 123 of the cutter drive gear 122, which causes a break in the meshed interaction with the drive gear 116 of the drive wheel 110. At that point, drive peg 118 is brought into interaction with the upstanding curved rack of teeth 126 such that for each rotation of the drive wheel 110 the cutter wheel 120 is 'kicked on' on by one tooth of the curved rack 126. Ultimately, the cutter wheel 120 gets 'kicked on' sufficiently that the drive gear 116 again meshes with the outer gear teeth 123 of the cutter drive gear 122 thereby resuming the normal drive relationship between drive wheel 110 and cutter wheel 120.

In an improvement to the basic intermittent drive means, there is further provided a control function to control (i.e. hold still) the cutter wheel 120 during the cutting interval. The control function is provided an upstanding broken circular wall 125 (which forms a control surface) provided to the drive wheel 110 and arranged to engage/disengage several spaced control pegs 142*a*-*d* provided to the cutter wheel 120. In more detail, two of these pegs 142*a*, 142*d* are outside the wall 125 and two pegs 142*b*, 142*c* inside the wall. The interaction of various pairings of pegs (e.g. 142*a* and 142*b*; 142*b* and 142*c*; 142*c* and 142*d*; or 142*d* and 142*a*) with the curved wall 125 on the drive wheel can provide the desired engagement of the cutter wheel 120. The engage/disengage movement of the broken circular wall 125 with the several control pegs 142*a*-*d* is arranged such that the wall 125 disengages the several control pegs 142*a*-*d* just prior to engagement of the drive peg 118 with the curved rack 126 and engages the several control pegs 142*a*-*d* subsequent thereto. Thus, again the cutter wheel 120 never has any free movement, which could for example, otherwise lead to it either not cutting the can or to it becoming un-synchronised with the drive wheel 110. This type of control mechanism may be regarded as a 'rotating wall Geneva'.

Figure 10:
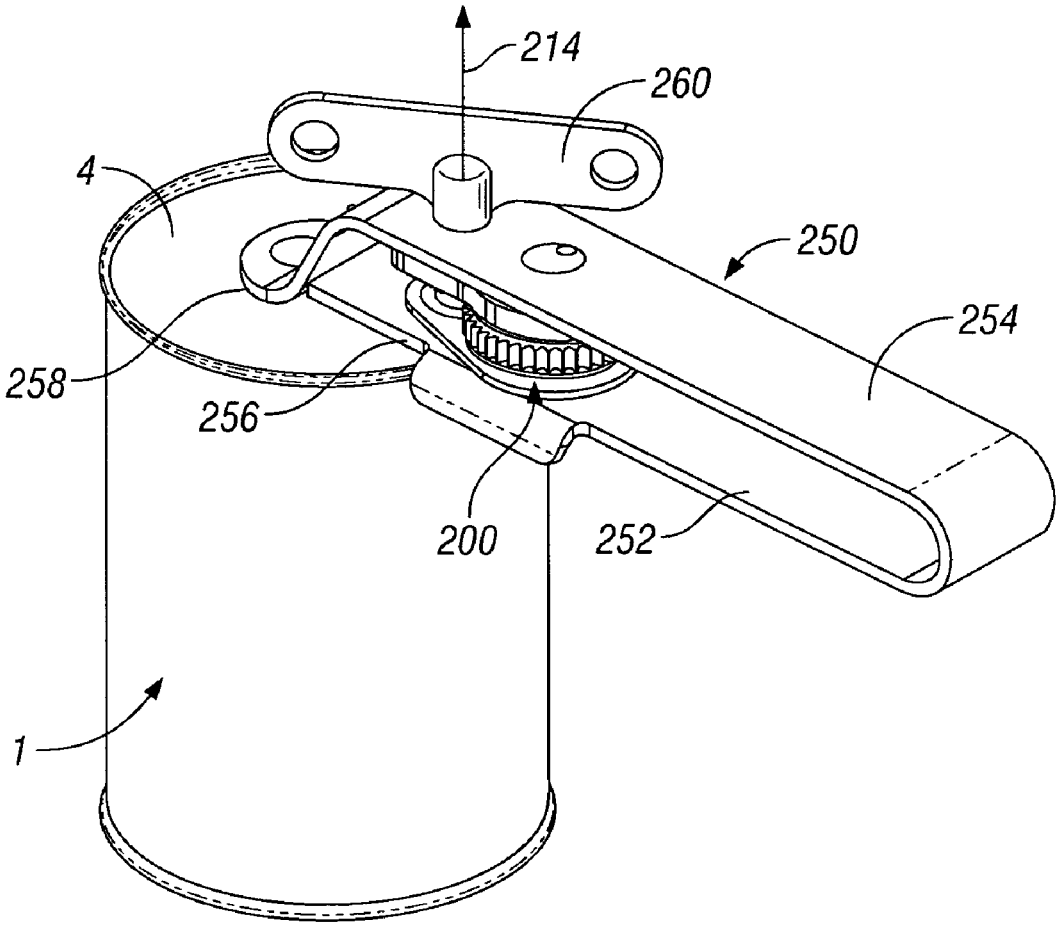
FIG. 10 shows a can opener including the can opener mechanism herein and its interaction with a can.

FIG. 10 shows a manual can opener 250 herein, which may incorporate either the first or second can opener mechanisms as described with reference to the earlier drawings.

The can opener 250 comprises a body 252 defining a handle 254; a jaw 256 for receipt of the lid 4 part of a can 1; and a support part 258 for resting on the lid 4. The can opener mechanism 200 sits within a cavity defined by the body 252. Twist handle 260 is mounted for rotation on the drive axis 214 such that rotation thereof results in rotational drive being provided to the drive wheel of the can opener mechanism 200. This version of the can opener 250 has an open body 252. In variations, a closed or semi-closed body with mechanism 200 inside is also possible. The body 252 can be comprised of any suitably rigid material (e.g. thermoplastics to metals) to house and space the mechanism 200 and is suitably designed to be ergonomic in use.

FIGS. 11*a* to 13 show different views of an automatic can opener 350 herein, incorporating the first can opener mechanism 300 as described with reference to the earlier drawings. In alternative embodiment, the second can opener mechanism of FIGS. 8 and 9 is substituted. This version of the automatic can opener 350 may be placed onto a can 1, and once started (by button 360), brings the cutter wheel to the cutting position, in which the cutting knife penetrates through the cylindrical wall of the can, the drive means then rotates the drive wheel to cause the opener to orbit around the can to form the cut therein.

After one rotation, the lid 4 is cut and the cutter wheel is moved out of its cutting position. The auto can opener 350 can then be lifted off, and the now cut lid 4 can also be lifted off.

The automatic can opener 350 comprises a cigar-shaped body (in variations, other shapes are possible) formed by mating top 352 and bottom 353 body parts and defining a handle 354 for the user's grip. The top body part 352 has sprung power button 360 provided thereto, which may be used to actuate drive motor 362, which is powered by batteries 363*a*, 363*b* for automatic operation of the opener mechanism. The bottom part 353 is shaped for receipt of the lid part of a can (not shown) within jaw 356. Protruding into the jaw 356 may be seen drive wheel 310 and circular cutting knife 328, which in a cutting operation form a cutting nip at the can.

In use, drive motor 362 provides drive to the can opener mechanism 300 at drive wheel 310 through gear train 364*a-c*. The drive motor 362 is responsive to actuation of the power button 360, which in turn can directly operate switch contact 368 (or in an alternative, indirectly e.g. with a micro switch). The can opener 350 is arranged to switch off automatically at the end of a can opening operation by the action of stop cam 369 mounted at the cutter wheel 320. Other sensors or switches may be provided e.g. to prevent start when can 1 is not present; or when the lower body part 353 has been removed for cleaning etc. The drive motor 362 may alternatively be controlled by other logic e.g. microprocessor etc. to provide extra functions such as speeding up the entry and exit phases of the cycle; triggering two or more cycles for larger cans; monitoring battery status; monitoring current consumption; and/or sensing end of cutting operation.

The essential features of the can opener mechanism correspond to those described in detail with reference to FIGS. 1 to 7*g*. Thus, the mechanism comprises toothed drive wheel 310 mounted on drive spindle 312 arranged for rotation about a drive axis. Also mounted on drive spindle 312 is drive gear 316, which is arranged to mesh with outer gear teeth 323 of the cutter drive gear 322 provided to cutter wheel 320 for drivable rotation thereof on cutter spindle 321 about a cutter wheel axis. On part of the cutter drive gear 322 several outer gear teeth 323 are missing and replaced by inner gear teeth (not visible) and upstanding curved rack of teeth 326.

Cutter wheel 320 is provided with a circular cutting knife 328, which eccentrically mounts thereto such that as the cutter wheel rotates about its axis the cutting knife 328 is brought into close proximity with drive wheel 310 to form a nip therebetween. The formation of this nip in use corresponds to a cutting position in which the cutting knife 328 penetrates through the cylindrical wall of a can to provide a cut therein as the opener orbits relatively therearound. Again, the cutting position is defined by a cutting interval corresponding to a segment of rotation of the cutter wheel 320 in which the cutting knife 328 is sufficiently proximal to the drive wheel 310 to form the nip. Spacer washer 330 with square spigot connector 331 and end washer 332 are provided to the cutter wheel and have the identical function to that of the first can opener mechanism. Also visible is control bar 340, which mounts to both the drive spindle 312 and cutter spindle 321 (and is laterally movable with respect thereto) is provided with a control peg 342 that meshes intermittently during the cutting interval with the inner gear teeth (not directly seen in FIG. 13) of the cutter wheel 320 (as described earlier).

An additional spring loaded gear or worm gear may be provided, in the gear train 364*a-c* before drive wheel 310, which can be used by compressing spring to engage and to manually rotate the mechanism in case of stalling due to low battery.

Figure 11A:
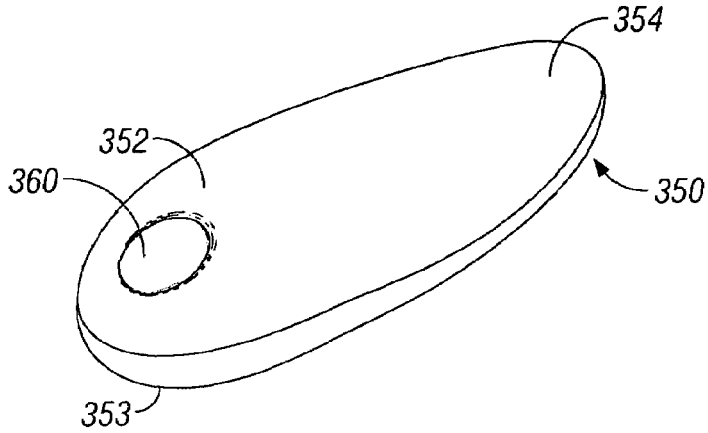
FIGS. 11*a* and 11*b* respectively show perspective top and bottom views of an automatic can opener including the can opener mechanism herein.
Figure 11B:
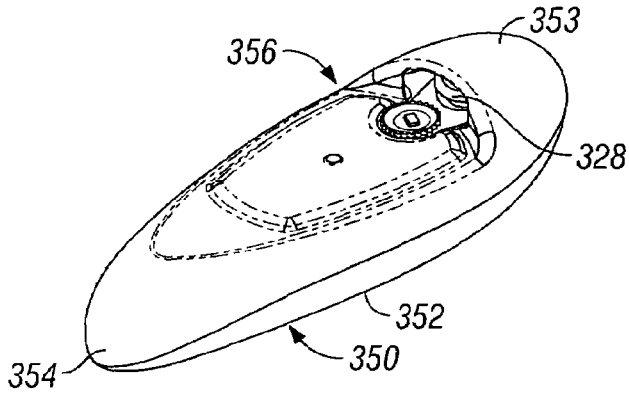
Figure 12:
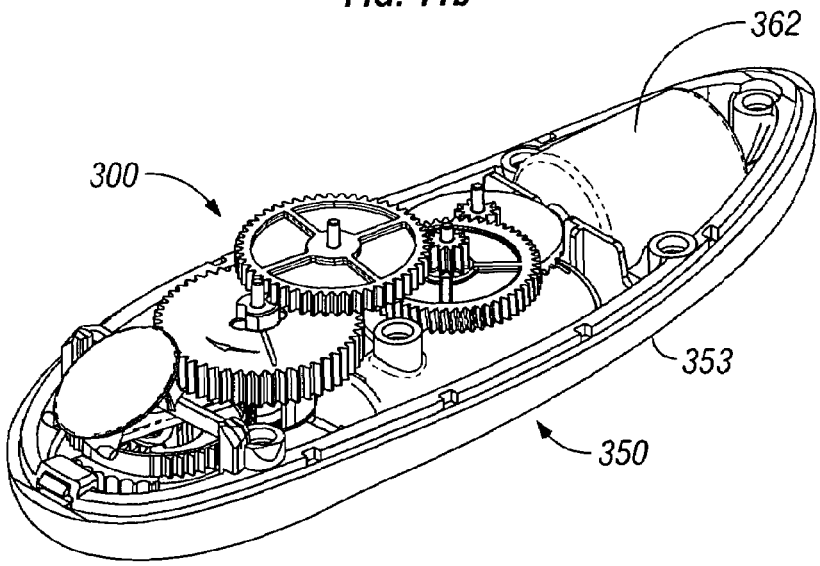
FIG. 12 shows a perspective view of the automatic can opener of FIGS. 11*a* and 11*b* with its top housing portion removed.
Figure 13:
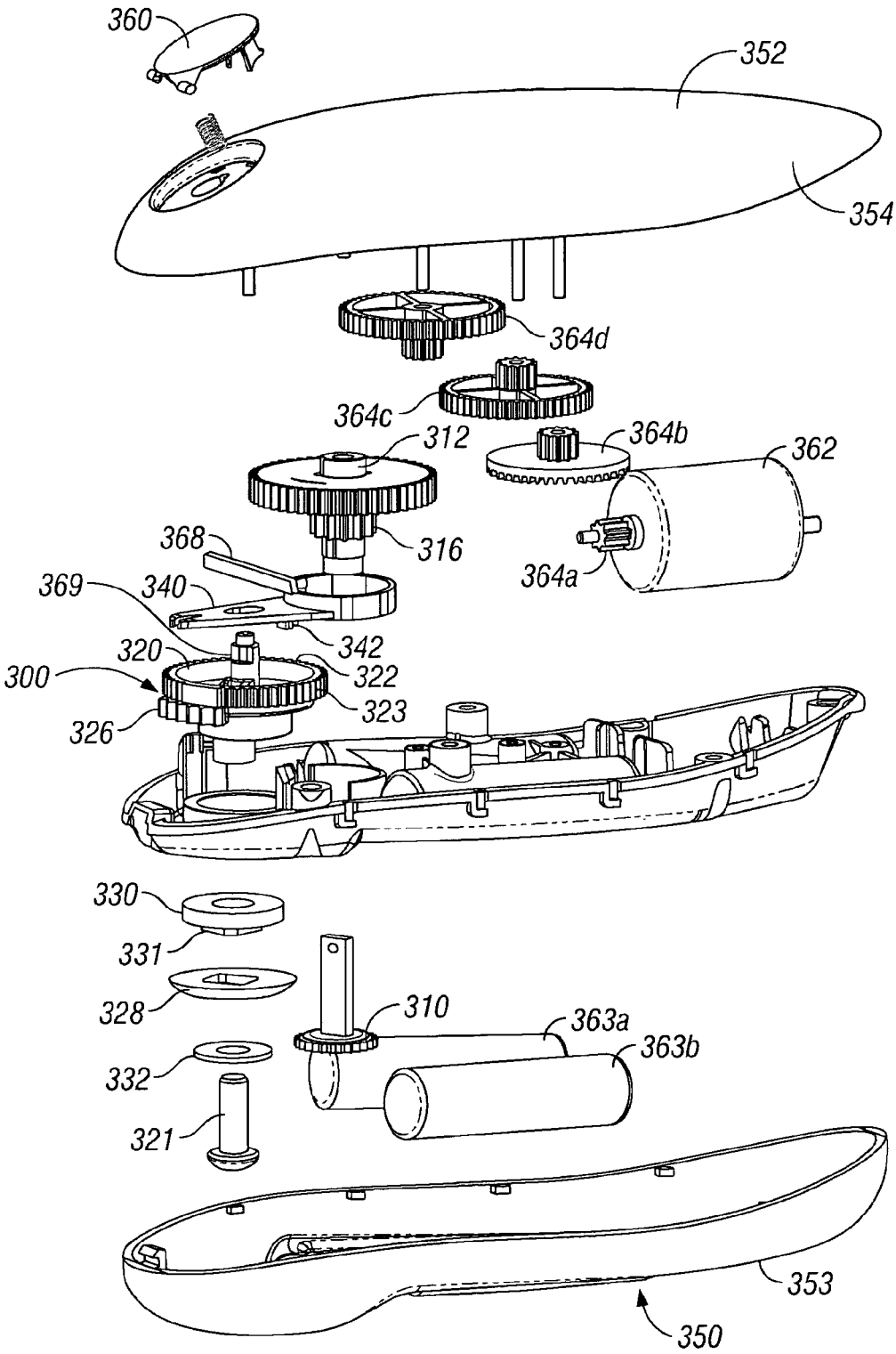
FIG. 13 shows an exploded view of the automatic can opener of FIGS. 11*a* and 11*b;*

There are several alternatives to providing a strict feed-forward control of the automatic can opener 350 seen in FIGS. 11-13. In the cutting of a can 1, manual control can be had based upon visual observation, where a user can take action once the can opening operation is complete. Automatic control can be had based upon the physical changes in the cut can 1, as well as indicia from the energy involved in the can cutting operation.

Figure 14:
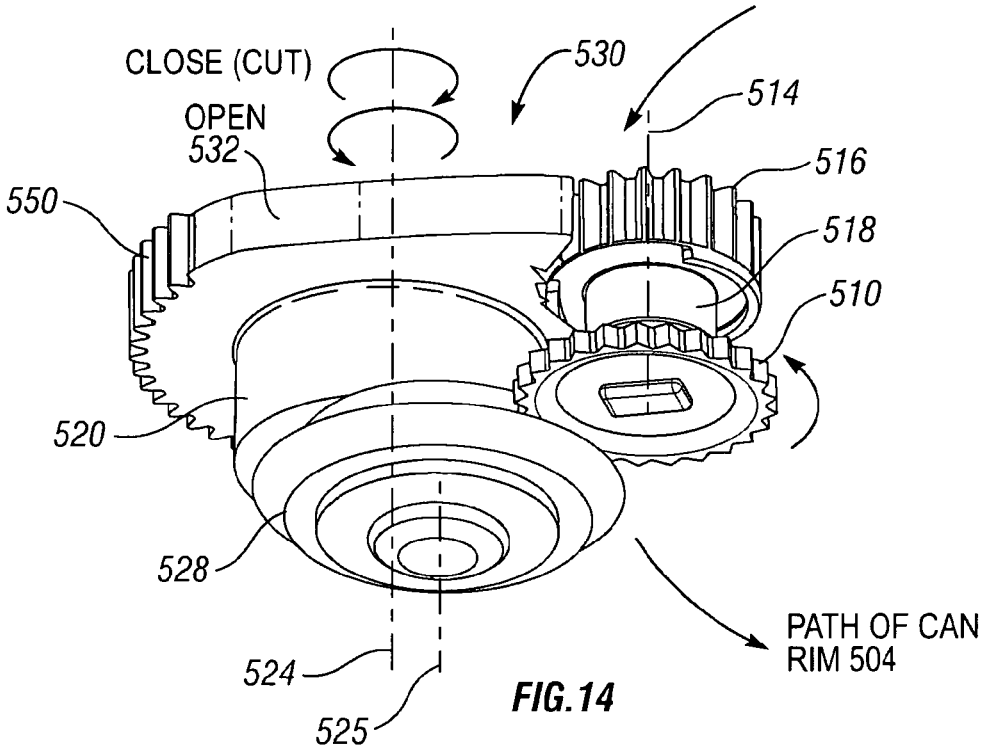
FIG. 14 shows a perspective view of the automatic can opener mechanism in which a structure for accommodating drive gear reversal is facilitated

FIG. 14 shows a perspective view of the can opener mechanism isolated on a number of components including a toothed drive wheel 510 which is operably connected, adjacent an axis 514 about which, to a toothed drive wheel 516 by a shaft 518. A cutter wheel 520 is mounted on an axis 524. The cutter wheel 520 supports an axis 525 which is offset from the axis 524 about which the cutter wheel 520 rotates. A circular cutting knife 528 is mounted to rotate freely about the axis 525. A specialized structure 530 is mounted above the cutter wheel 520 and which includes a smooth exterior wall 532. To the left of smooth exterior wall 532 a set of gear teeth 550 are seen.

Figure 15:
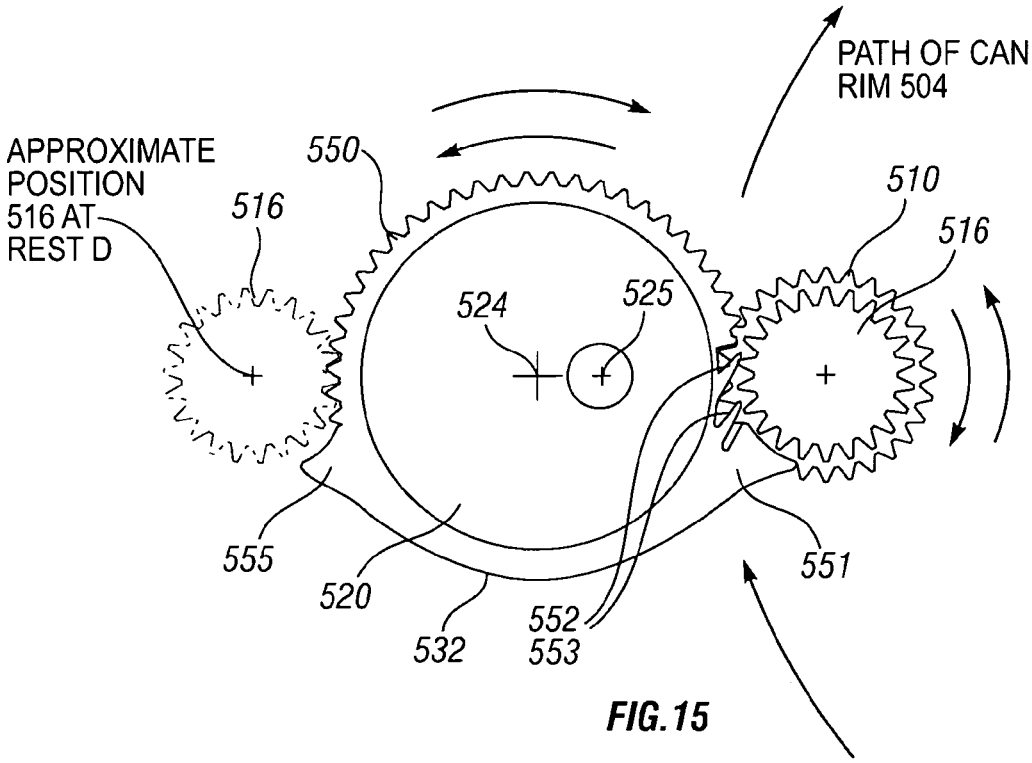
FIG. 15 illustrates a top view of the mechanism shown in FIG. 14, including details of the ratchet action teeth and protrusion which enables the cutter wheel to operate only over a half turn.

FIG. 15 is a top view of the assembly seen in FIG. 14. The axes 524 and 525 are seen. In addition, to the right of smooth exterior wall 532 is a curved stop 551 having a surface of about the same radius as the tips of the teeth on the drive wheel 516. Immediately adjacent the curved stop 551 are a pair of elongate ratchet action teeth 552 and 553 which run deep into the specialized structure and which are angled to form a ratchet action. The depth of the teeth 552 and 553 into the specialized structure 530 will depend upon the material from which the specialized structure 530 is made, as the ratchet effect requires the teeth 552 and 553 to be able to deform as the teeth of the toothed drive wheel 516 moves the teeth adjacent teeth 552 and 553 and is able to click upon teeth 552 and 553 when the pivoting motion of the specialized structure 530 is stopped by the curved stop 551. In the direction shown in FIG. 15, as the toothed drive wheel 516 continues to turn, very little friction is had either against the curved stop 551 or the ratcheting teeth 552 and 553 as teeth of the drive wheel or a cylindrical wall adjacent to the teeth continues to turn against these structures.

The provision of both the curved stop 551 and the ratcheting teeth 552 and 553 insures that the specialized structure 530 will achieve a stable terminal position. Simply removing teeth adjacent the curved stop 551 would not insure a stable and fixed position. Where the drive wheel 516 is reversed, the ratcheting teeth 552 and 553 are in perfect position to cause the specialized structure 530 to reverse its direction without delay and without binding, due to the position of the ratchet oriented teeth ratcheting teeth 552 and 553. In this configuration a stable forward cut can be maintained during the time that drive wheel 516 is moved in the forward direction and over any length of can 1 to be cut, with reversal of drive wheel 516 resulting in a known amount of time necessary for the specialized structure 530 to return to its original position, one hundred eighty degrees from the position shown in FIG. 15. A second stop 555 may be provided to form a stable, exacting position at such reversed orientation.

The operations and controls which can be made related to the invention of FIGS. 14 and 15 are many. In one such usage, the automatic can opener 350 starts in 'rest' or 'open' position with the circular cutter knife 528, at a distance from the toothed drive wheel 510. This is the approximate position where the opener is put on the can, and is similar to an original start position. Once on the can, the drive gear 516 is rotated (such as by hand power, geared electric motor, etc.), but preferably electrically. This rotates the cutter wheel 520, by approximately 180 degrees to the position shown in FIGS. 1 & 2, which is the engaged position where can 1 cutting and opening will occur. In this position the drive gear continues to turn (in the same direction), and the can rim is trapped and lid cut as before. Due to the fact that the elongate ratchet action teeth 552 and 553 present themselves before the drive gear 516 and protrusion 551 preventing further rotation of cutter wheel 520, the mechanism continues in this position as long as the drive gear 516 continues to rotate in the same direction, and can cutting continues. The forces from cutting, in the direction of cut, plus the position of the eccentrically mounted cutting wheel axis 525, plus any 'over-centre' forces, are arranged to hold the cutter wheel (520) in this 'cutting' position.

Once the can lid 4 is completely cut, the rotation of the toothed drive gear 516 may be reversed, either by reversing the polarity of the drive motor or simply having the user simply reverses the direction of rotation to release the lid 4. When a dc motor is used, changing its polarity will reverse its direction. To make this reversing automatic an 'end of cut sensor' may be used. This can be done in a wide variety of ways, for example, it can be done electronically by sensing the drop in current draw, when the can is opened.

Figure 16:
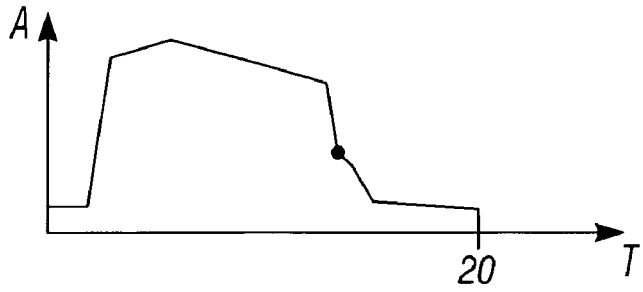
FIG. 16 illustrates a graph of current in amps versus time t and which can be utilized as a sensing parameter to perform polarity reversal of the motor where a reversal action can be utilized operate the cutting wheel in reverse.
Figure 17:
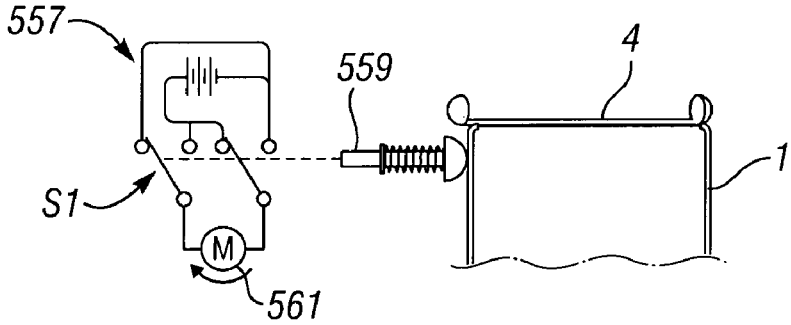
FIG. 17 is an electrical schematic shown conjunction with a mechanical schematic in which a sensing switch can provide motor polarity reversal.

Referring to FIG. 16, a graphical representation approximating the current demand of a motor (ordinate) versus time (abscissa) used in a can cutting operation is illustrated. The first portion shows a low current as would be expected when the cutter wheel is being rotated into place. A sharp rise would occur as the cutting knife 528 penetrates the can, and goes through a maximum as penetration is made. The end of the plateau represents a state where the current drops off rapidly which is expected to occur when the can 1 lid 4 is completely cut. A dark circle is shown as a potential trigger point. The reversal of the electric motor can also be accomplished mechanically. Referring to FIG. 17, a schematic diagram is shown which includes a circuit 557 with battery and a double pole double throw switch S1 which is shown as mechanically linked (shown by a dashed line) to a plunger 559 shown in contact with the side of can 1 to which lid 4 is attached. A motor 561 is shown as operating in the forward direction with the negative terminal of battery B in contact with the motor 561 left terminal.

Figure 18:
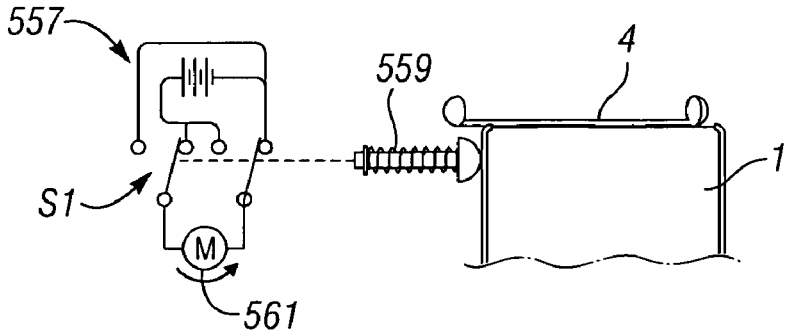
FIG. 18 illustrates the side, semi-sectional view of the mechanism shown in FIG. 17, and in which a switch has achieved reversal after can movement is sensed

Referring to FIG. 18, a schematic diagram is shown as in FIG. 17, but, in this figure, the can 1 has been separated from lid 4 enabling plunger 559 to shift to the right as the combination of can lid 4 and automatic can opener 350 is displaced away from the cut can 1. Movement of the plunger 559 causes switch S1 to change position so that the negative terminal of battery B in contact with the motor 561 right, to reverse the direction of the motor 561. Other alternatives, such as a relay, a mechanical idler gear, distance sensor, the use of an electronic controller chip, optical sensor and the like can be employed. The same mechanism could be operated with a manual switch or the like. Regardless of the mechanism which is used to achieve reversal, once the toothed drive gear 516 rotates in reverse direction, a free-wheel engages, which re-engages the gear teeth 550 of cutter wheel 520. The free-wheel action can be achieved by either be integrally moulded, with the elongate ratchet action teeth 552 and 553 formed as cantilever pawls acting directly on the teeth of drive gear 516, or, it can be positioned anywhere between cutter wheel 520 and drive gear 516, integrally moulded, as shown or using separate parts, and in a variety of vertical positions. Free-wheels are common mechanisms and can be manufactured by a variety of methods, such as wedges, pawls, spring wraps, and more. Once the cutter wheel 520, is rotated back to the start position it preferably comes against the optional end stop as second stop 555. In the electrical version, power is cut at this 'start' position. The advantage of this method is that a can with any length of cut can be opened automatically. Once opened the can opener is immediately disengaged from the can and returns to the start. A manual version is particularly useful because it may contain fewer parts, such as the toothed drive gear 516, and cutter wheel 520 parts. The action of reversing the drive, also releases the lid—which can be positioned over the waste bin, avoiding having to touch the lid.

Figure 19:
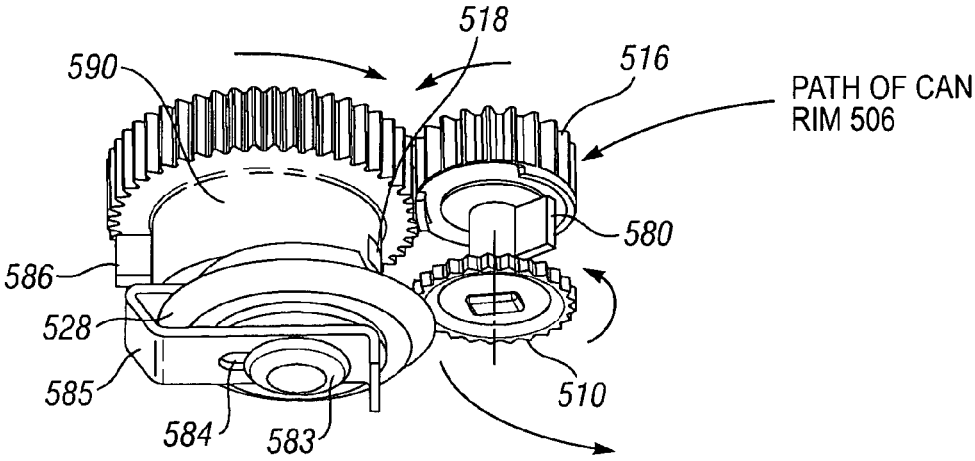
FIG. 19 shows a perspective view of the automatic can opener mechanism in which a structure for accommodating continuous, one directional operation of the cutter wheel along with the use of a spring urged locking bar and can sensor combination, and including a bar which rotates with the drive gear.

Referring to FIG. 19 a perspective view of a further embodiment of the automatic can opener mechanism is shown in which a structure for accommodating continuous, one directional operation of the cutter wheel along with the use of a spring urged locking bar and can sensor combination. In addition to the components previously shown, the toothed drive wheel 516 includes a bar 580 which extends near the outer edge of the toothed drive wheel 516 and is set to enable it to contact a structure which is brought close enough to the shaft 518.

Figure 20:
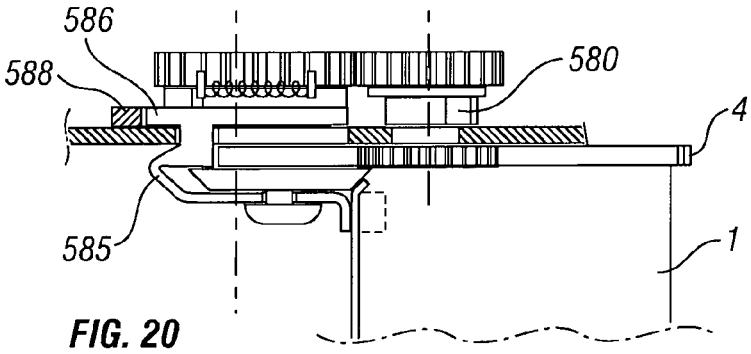
FIG. 20 illustrates a side, semi-sectional view of the mechanism shown in FIG. 19, including one possible configuration of a linkage between a can sensor and a locking bar.

A vertical bolt 583 (which may be part of the rotary cutter wheel mounting) engages a slot 584 in a clip shaped can sensor 585 to enable it to move back and forth in the direction of the slot 584. Referring also to FIG. 20, it can be seen that the sensor 585 is linked to a locking bar 586 shown, which may be urged with a spring 587 with an end which can engage a matching fixed socket 588 which may be part of a housing or other fixed matching opening. The locking bar 586 is supported within and through openings in either end of a cutter wheel 590.

Figure 21:
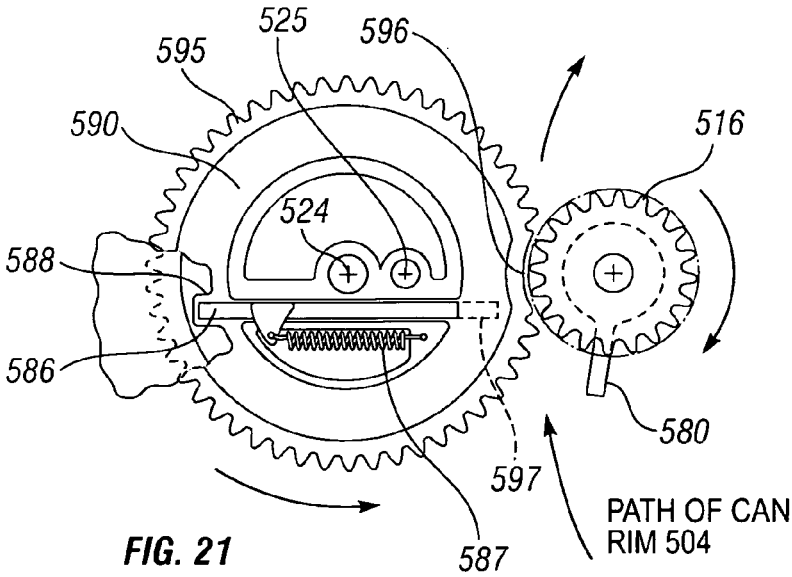
FIG. 21 illustrates a top view of the mechanisms seen in FIGS. 19 and 20 and illustrating the action of the locking bar and bar which rotates with the drive wheel.

Referring also to FIG. 21 it can also be seen that the locking bar 586 is offset from the axis 524 of the cutter wheel 590, but in a direction which is also displaced from a parallel line through the axis 524 of the cutter wheel 590 and through the axis 525 which supports the cutting knife 528. The position shown in FIG. 21 is the cutting position where the locking bar 586 is moved back into the holding slot or socket 588. As can be seen, a set of teeth 595 on the cutting wheel are removed at an area 596 directly opposite the drive wheel 516. Also shown in dashed line format is the spring urged position 597 which the locking bar would achieve it if were not being pushed by the presence of can 1.

The operation will be best illustrated by viewing all three FIGS. 19-21 simultaneously. In rest or start position the locking bar is located to one side of the axis 524 seen with respect to FIG. 21, and extending away from the urged position 597 which would point to the left, above and away from the toothed drive wheel 516. A user places a can lid into a position between the toothed drive wheel and the circular cutting knife 528, since the cutting wheel 590 is in a position which displaces the circular cutting knife 528 away from toothed drive wheel 516.

Once the automatic can opener 350 is started, and taken with respect to FIG. 21, the drive wheel 516 begins turning clockwise. Just before beginning to turn, it should be noted that the elbow or turning position of the sensor 585 as it partially surrounds the cutting knife 528 is adjacent and above (or below as seen in FIG. 19) the drive wheel 516 seen in FIG. 21, does not interfere with the toothed drive wheel 510. This is due to the eccentricity, axis 525 spaces the sensor, and cutting knife away from toothed drive wheel 510. Clockwise turning of the drive wheel 516 causes the cutter wheel 590 to turn counterclockwise, taken with respect to FIG. 21, until the mechanism achieves the position shown in FIG. 21. The sensor 585 turns along with the cutter wheel 590 into the position shown in FIG. 19 until the presence of the can 1 causes the sensor 585 to move away from the can 1 as the curved tip end of the sensor 585 aligns with and is engagably pushed by the can. This is shown in FIG. 20. Inasmuch as the sensor 585 and its locking bar 586 is spring urged by spring 587, the presence of the can 1 pushes the sensor 585 and locking bar 586 into locking engagement with the holding socket 588. In this position, the cutter wheel is locked just as the area 596 having no teeth is directly opposing the drive wheel 516. In this orientation, the presence of the can 1 enables continued locking of the locking bar 586 as the drive wheel 516 continues to turn urging the toothed drive wheel 510 to continue cutting the can 1. Note that the locking bar 586 is cleared into the cutter wheel 590 and well clear of position 597 and that the passing of the bar 580 will have no effect on the cutter wheel 590.

Once the can 1 has completed the cutting operation, the can 1 shifts to the right as seen in FIG. 20 to unlock the cutter wheel 590 and thereby enable the sensor 585 and locking bar 586 to move to the right with respect to FIG. 20, to occupy position 597. The drive wheel 516 continues to turn within the area 596 for a moment until the bar 580 reaches a position to contact with the end of the locking bar 586 in its position 597. The bar 580 then pushes the cutter wheel 590 far enough for the teeth 595 to engage the teeth of the drive wheel 516 to cause the cutter wheel 590 to continue in its counterclockwise path.

As the elbow between the sensor 585 and the locking bar 586 come around, the circular cutting knife 528 is moved sufficiently far from the toothed drive wheel 510 to enable the elbow between the sensor 585 and the locking bar 586 pass between the circular cutting knife 528 and the toothed drive wheel 510. As soon as the elbow will have passed by the toothed drive wheel 510, the mechanism will have achieved its start position and will be ready for the introduction of a new can 1 for cutting. The sensor 585 is seen as being relatively wide, but depending upon materials chosen, and the degree to which the locking bar 586 is displaced from the center axis 524 of the cutter wheel 590 the width can be narrowed or widened as needed or permitted.

As was the case for the embodiment of FIGS. 15-18, the advantage obtained will include that any diameter of can, can be opened with one actuation of the automatic can opener 350. Once opened the can opener is almost immediately disengaged from the can and returns to the starting position. The advantage of this method is particularly useful because the end of cut is triggered by the mechanical end of can sensor 585. This avoids having to reverse the powered drive motor, and so enables operation without an electronic sensor, or polarity change-over switch. This method, whilst using more parts is still operated simply by turning the drive gear 516 in the same direction. Thus the ability to perform opening without overlap cut or restarting is a useful innovation.

While the preferred embodiments of the invention have been shown and described, it will be understood by those skilled in the art that changes of modifications may be made thereto without departing from the true spirit and scope of the invention.

We claim:

1. A can opener mechanism for use in an opener for a can, said can comprising a cylindrical wall closed at each end with a circular lid fixed thereto by means of an upstanding rim around the edge of said lid that clamps onto said each end of said cylindrical wall, said mechanism comprising a body;

rotationally mounting to said body about a first axis, a drive wheel for engaging the rim of the can;

rotationally mounting to said body about a second axis and drivably rotatable by said drive wheel, a cutter wheel; eccentrically mounting to said cutter wheel, a cutting knife movable on rotation of the cutter wheel to a cutting position in which the cutting knife forms a nip, with its associated structures, with the drive wheel such that the cutting knife penetrates through the cylindrical wall of the can and to provide a cut therein as the opener orbits relatively therearound, wherein said cutting position is defined by a cutting interval corresponding to a segment of rotation of the cutter wheel in which the cutting knife is sufficiently proximal to the drive wheel to form said nip, with its associated structures, provided to the cutter wheel, intermittent drive means for providing intermittent drive between the drive wheel and the cutter wheel when the cutting knife is in the cutting position to maintain the nip, with its associated structures, in place for a sufficient cutting interval to provide a full orbital cut around the cylindrical wall of the can;

a mechanical sensor, associated with said mechanism, for sensing separation of the can with respect to the circular lid; and a locking bar which locks said cutter wheel when said mechanical sensor is activated.

2. A can opener mechanism according to claim 1, wherein the drive wheel and the cutter wheel are in a direct drive relationship.

3. A can opener mechanism according to claim 1, wherein the cutting knife has circular form.

4. A can opener mechanism according to claim 1, wherein the intermittent drive means comprises a Geneva mechanism.

5. A can opener mechanism according to claim 1, wherein at the cutting position the usual drive relationship between the drive wheel and the cutter wheel is disengaged.

6. A can opener mechanism according to claim 5, wherein the cutter wheel has missing teeth at the segment thereof.

7. A can opener mechanism according to claim 1, wherein the cutter wheel turns in a forward and reverse cycle of less than three hundred sixty degrees.

8. A can opener mechanism according to claim 1, wherein the cutter wheel turns in one direction only.

9. A can opener mechanism for use in an opener for a can, said can comprising a cylindrical wall closed at each end with a circular lid fixed thereto by means of an upstanding rim around the edge of said lid that clamps onto said each end of said cylindrical wall, said mechanism comprising a body;

rotationally mounting to said body about a first axis, a drive wheel for engaging the rim of the can;

rotationally mounting to said body about a second axis and drivably rotatable by said drive wheel, a cutter wheel; eccentrically mounting to said cutter wheel, a cutting knife movable on rotation of the cutter wheel to a cutting position in which the cutting knife forms a nip, with its associated structures, with the drive wheel such that the cutting knife penetrates through the cylindrical wall of the can and to provide a cut therein as the opener orbits relatively therearound, wherein said cutting position is defined by a cutting interval corresponding to a segment of rotation of the cutter wheel in which the cutting knife is sufficiently proximal to the drive wheel to form said nip, with its associated structures, provided to the cutter wheel, intermittent drive means for providing intermittent drive between the drive wheel and the cutter wheel when the cutting knife is in the cutting position to maintain the nip, with its associated structures, in place for a sufficient cutting interval to provide a full orbital cut around the cylindrical wall of the can, a sensor, associated with said mechanism, for sensing separation of the can with respect to the circular lid; and and wherein said intermittent drive means reverses to disengage upon sensed separation of the can.

10. A can opener mechanism according to claim 9, wherein the sensor is a mechanical sensor.

11. A can opener mechanism according to claim 9, wherein the sensor is an electronic sensor.

12. A can opener mechanism according to claim 9, wherein the drive wheel and the cutter wheel are in a direct drive relationship.

13. A can opener mechanism according to claim 9, wherein the cutting knife has circular form.

14. A can opener mechanism according to claim 9, wherein the intermittent drive means comprises a Geneva mechanism.

15. A can opener mechanism according to claim 9, wherein at the cutting position the usual drive relationship between the drive wheel and the cutter wheel is disengaged,

16. A can opener mechanism according to claim 15, wherein the cutter wheel has missing teeth at the segment thereof.

17. A can opener mechanism according to claim 9, wherein the cutter wheel turns in a forward and reverse cycle of less than three hundred sixty degrees.

18. A can opener mechanism according to claim 9, wherein the cutter wheel turns in one direction only.

* * * * *